US005384630A

United States Patent [19]

Nakamura et al.

[11] Patent Number: 5,384,630

[45] Date of Patent: Jan. 24, 1995

[54] PRESSURE ROLLER DRIVER FOR SHEET FORWARDING APPARATUS

[75] Inventors: Yasuo Nakamura; Yoshio Kogure; Hideo Ichikawa; Takuji Miyazawa; Takahiko Ryuzaki, all of Kanagawa, Japan

[73] Assignee: Fuji Xerox Co., Ltd., Tokyo, Japan

[21] Appl. No.: 125,214

[22] Filed: Sep. 23, 1993

[30] Foreign Application Priority Data

Sep. 24, 1992 [JP] Japan ..... 4-279357

[51] Int. Cl.[6] ..... G03G 15/14

[52] U.S. Cl. ..... 355/277; 355/271; 355/273; 271/275

[58] Field of Search ..... 355/271, 277–281, 355/273, 274, 275, 272, 326 R, 327, 308, 309, 321; 271/270, 275

[56] References Cited

U.S. PATENT DOCUMENTS 4,183,658 1/1980 Winthaegen ..... 355/277 X
4,541,709 9/1985 Kampschreur ..... 355/277
4,908,674 3/1990 Fukano et al. ..... 355/309 X
5,168,290 12/1992 Tanaka et al. ..... 355/271 X
5,170,209 12/1992 Tompkins et al. ..... 355/271 X
5,189,470 2/1993 Matsuda et al. ..... 355/309 X
5,305,068 4/1994 Sato et al. ..... 355/309

FOREIGN PATENT DOCUMENTS 59-22227 2/1984 Japan .
1-107280 4/1989 Japan .

*Primary Examiner*—Matthew S. Smith
*Attorney, Agent, or Firm*—Finnegan, Henderson, Farabow, Garrett & Dunner

[57] ABSTRACT

A sheet forwarding apparatus for supporting a sheet on a transfer drum in a electrophotographic copying machine, onto which a toner image on a photoreceptor drum is transferred, which apparatus includes a pressure roller for pressing the sheet onto the transfer drum while forwarding. An arm member supports the pressure roller and is pivotable around a shaft so as to cause the pressure roller to alternately contact and distance from the transfer drum. An oscillating unit is included for oscillating the arm member, and to apply a constant pressure to the sheet through the pressure roller when the pressure roller is in contact with the transfer drum.

2 Claims, 2 Drawing Sheets 2
3
15
α
17
23
24
26
25
18
16
13
23a
20
21
22
11
10
12

PRESSURE ROLLER DRIVER FOR SHEET FORWARDING APPARATUS

BACKGROUND OF THE INVENTION

The invention relates to a color electrophotographic copying machine of such a system that color toner images are transferred and superposed one upon another onto a sheet while the sheet is held by a transfer drum. More particularly, the invention is directed to a device that can set a biasing force using a spring with a bias roller oscillated to a biasing position by a cam member, the bias roller being disposed at such a position as to allow the sheet to be held on the transfer drum.

In image forming apparatuses including color electrophotographic copying machines, it is known to dispose developing units for a plurality of colors along a linearly arranged sheet forward paths as disclosed in Japanese Patent Unexamined Publication No. 22227/1984 and the like. This conventional example employs a system in which a plurality of color toner images are transferred onto a sheet from the respective developing units while sequentially superposed one upon another, the sheet passing through the sheet forward paths. Different from such conventional example, e.g., a color electrophotographic copying machine disclosed in Japanese Patent Unexamined Publication No. 107280/1989 is characterized as arranging a plurality of developing units around a cylindrical sheet supporting drum so that a plurality of color toner images can be transferred onto a sheet from the respective developing units and superposed one upon another while the sheet being held on the drum is moving.

Instead of the system in which a plurality of developing units are arranged so that color toner images are transferred onto a sheet from the respective developing units as described above, e.g., an apparatus having the following feature is proposed in Japanese Patent Unexamined Publication No. 238480/1990. That is, a plurality of developing units are arranged around a photoreceptor drum, and a transfer drum supporting a sheet is disposed so as to correspond to the photoreceptor drum. A color electrophotographic copying machine using the above-mentioned transfer drum, which supports a sheet in such a manner as to allow the sheet to adhere to the transfer drum electrostatically, transfers a color toner image onto the sheet so as to be superposed on the sheet every time a color toner image is formed on the photoreceptor drum, separates the sheet from the transfer drum after all the color toner images have been transferred onto the sheet, and forwards the image transferred sheet toward a fusing unit.

As described above, the color electrophotographic copying machine of such system that color toner images formed on the photoreceptor drum are transferred onto a sheet while superposed one upon another with the sheet being supported by the transfer drum employs a transfer drum such as shown in FIG. 3. The transfer drum shown 2 in FIG. 3 disposes a photoreceptor drum 1 so as to confront thereto that supports a sheet. Around the photoreceptor drum 1 a plurality of developing units are disposed, which contain toners of different colors, respectively. One of the developing units forms a toner image of a single color, and the formed color toner image is transferred onto a sheet. A charging means, an image transfer means, a cleaning unit, and the like may be arranged for the photoreceptor drum 1, such as conventional electrophotographic copying machines.

A sheet carrying surface of the transfer drum 2 located at a position corresponding to the photoreceptor drum 1 is formed of a thin plastic film member so that a sheet adheres to such film member electrostatically. In the example shown in FIG. 3, to cause the sheet to adhere to and be held on the surface of the transfer drum 2, an adsorbing corotron 4 is arranged. By controlling discharge from the corotron 4 with a regulating plate 4*a*, the film that carries the sheet is electrically charged. Then, by pressing the sheet P with a pressure roller 3, the sheet P is subjected to adhere to the surface of the film. At a circumference of the transfer drum 2 and on the inner surface thereof, a transfer corotron 5 is positioned corresponding to the photoreceptor drum 1, so that a color toner image is transferred onto the sheet by the discharge from the transfer corotron 5.

Further, discharge corotrons 6 and a separating corotron 7 are positioned on the upstream side of a claw member for separating the sheet, which serve as auxiliary means for separating the sheet from the surface of the transfer drum. In addition to the above-mentioned components, a cleaning unit 8 is disposed so as to near and leave the transfer drum, so that the surface of the film can be cleaned with the sheet not carried on the surface of the transfer drum. On the upstream side of the sheet adhering position on the surface of the transfer drum are drum discharge corotrons 9, which electrically discharge the film member of the transfer drum before the surface is ready for the adhesion of a next sheet. The pressure roller 3, supported by a not shown oscillating member, performs an auxiliary sheet holding operation by pressing the sheet onto the surface of the transfer drum 2 when the sheet is forwarded by a resist roller unit 13 for adhesion to the surface of the transfer drum.

As described above, if the mechanism for pressing the pressure roller using the support arm member is employed in order to supply the sheet toward the transfer drum, the force for pressing the sheet by the pressure roller can be set to a predetermined value, which is an advantage. At the time, the dransfer drum 2 is constructed by flange frames positioned at both sides of the drum, a plurality of beam frames coupling the both flange frames as the drum and plastic film pasted on the frame of the drum. Accordingly, the plastic film has a portion held by the frame and a portion between the holding frames. In the case such that the sheet holding section of the transfer drum is made use of a film, the resiliency of the film varies from one portion to another, e.g., from the portion having the frame to a portion between the frames, thereby making inconsistent pressure in some cases toward the sheet by the pressure roller. Further, if the pressure force of the pressure roller is set stronger, a large pressure force is applied to sheet over the whole body of the transfer drum, thereby imposing the problem that the operation of supporting the sheet on the transfer drum may not be performed satisfactorily.

Still further, if it is designed to press the pressure roller with a stronger force, then it becomes difficult to remove a sheet when the sheet is jammed at the sheet pressing section or like inconveniences happen because there is no play in the arm member and the like which hold the pressure roller. Still further, since the arm member that supports the pressure roller is driven by a solenoid or the like, when the sheet is jammed between the transfer drum and the pressure roller, it is required that the drive of the solenoid be interrupted and that the pressure roller be distanced from the transfer drum thereafter, which is a cumbersome operation.

SUMMARY OF THE INVENTION

The invention has been made to overcome the above-mentioned problems associated with the conventional examples. Particularly, the object of the invention is to provide a device capable of performing the sheet pressing function satisfactorily by arranging a pressing means, using a spring, which is disposed between an arm member for supporting the pressure roller and an oscillating member, so that the pressure roller is resiliently pressed onto the transfer drum by the arm member.

The invention relates to an electrophotographic copying machine of such a system that a toner image formed on a photoreceptor drum is transferred onto a sheet by supporting the sheet on a transfer drum. In the invention, a pressure roller is disposed adjacent to the transfer drum in releasable therefrom; an arm member supporting the pressure roller is disposed in swingable by a support axis; and a drive means including a cam member and a pressing means including a spring are arranged for the arm member. As a result of the structure, a pressure force of the spring is operated upon oscillating the pressure roller onto the transfer drum by the cam member.

The constructed pressure roller driver of the invention is characterized as oscillating the oscillating arm member supporting the pressure roller indirectly through the spring member. Therefore, the pressure roller can be pressed onto the sheet supporting surface of the transfer drum resiliently. Further, the pressure roller driver of the invention is characterized as not driving the oscillating arm member directly. Therefore, even if a sheet is jammed at the pressure roller pressing section, the pressing operation of the pressure roller can be released readily, thereby allowing the jam to be taken care of with ease. Still further, the pressure roller supporting mechanism of the invention can adjust the sheet pressing force easily by adjusting the force of the torsion spring, thereby allowing the sheet to be held by the transfer drum while pressed by a necessary force.

DETAIL DESCRIPTION OF THE PREFERRED EMBODIMENT

Figure 1:
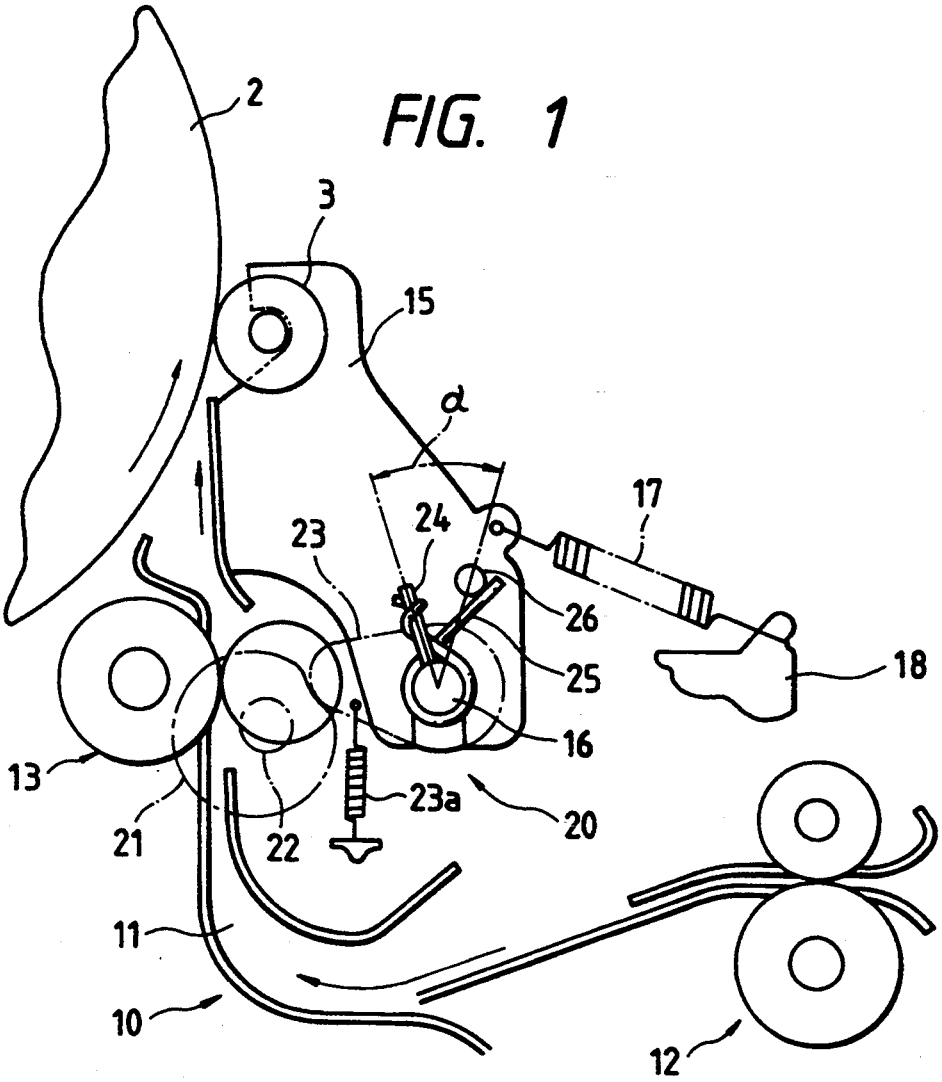
FIG. 1 is a side view showing an arrangement for oscillating a pressure roller of the invention.
Figure 3:
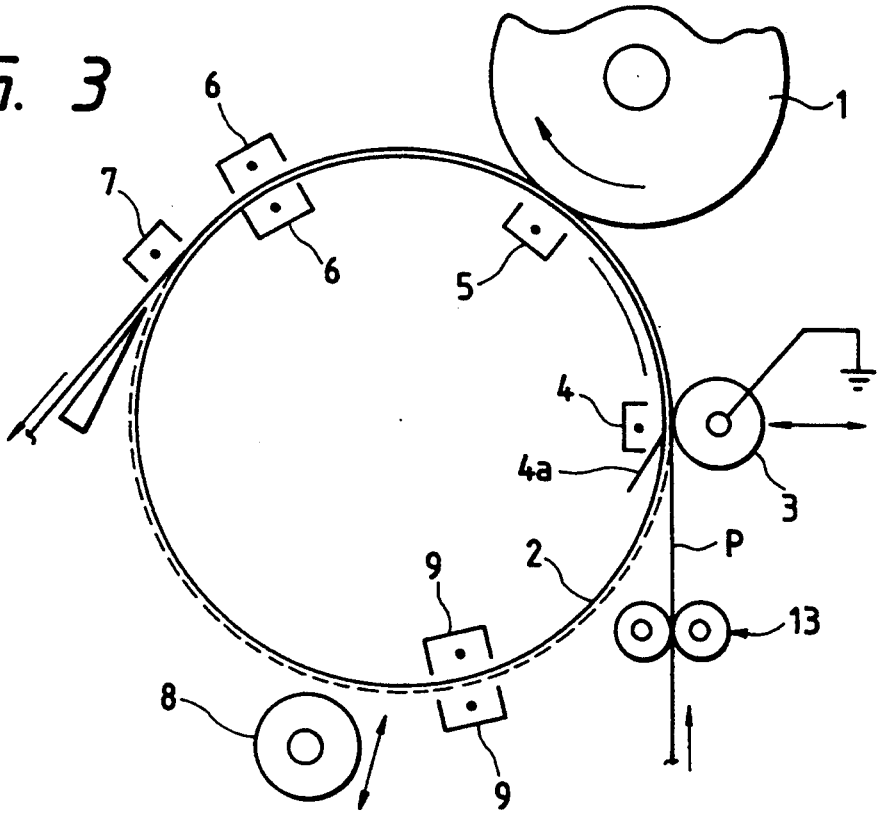
FIG. 3 is a diagram showing an arrangement of the transfer drum to which a pressure roller driver of the invention can be applied.

A pressure roller driver for a sheet forward apparatus of the invention will be described with reference to embodiment shown in the drawings. FIG. 1 shows a structure of an embodiment that includes an arrangement of a section for supplying a sheet toward a transfer drum and an arrangement of a sheet adjusting unit for conveying the sheet while aligning in the apparatus shown in FIG. 3. In the apparatus shown in FIG. 1, a pressure roller 3 is pressed onto a transfer drum 2, thereby the sheet which is supplied through a sheet adjusting unit 10 at the upstream of the pressure roller 3 is pressed onto the transfer drum 2.

The sheet adjusting unit 10 includes: a pre-resist roller unit 12 on the upstream of a sheet forward path 11, of the adjusting unit 11, which is formed as a bent path; and a resist roller unit 13 on the downstream thereof. In a state that a forward end of the sheet is held and stopped at a nip section between the resist rollers unit 13, the pre-resist roller unit 12 additionally forward the sheet, so that sheet adjustment can be effected while forming a loop on the sheet. In reception of a signal for supplying the sheet toward the transfer drum 2 after the sheet adjusting operation has been effected, the resist roller unit 13 is driven to forward the sheet toward the transfer drum 2. The sheet forwarded through the resist roller unit 13 is guided along a guide plate provided on an oscillating arm member 15 that supports the pressure roller 3, thereby the sheet is subjected to adhere to the surface of the transfer drum 2 while pressed by the pressure roller 3.

The pressure roller 3 for pressing the sheet onto the transfer drum 2 is supported by the oscillating arm member 15, and the oscillating arm member 15 is oscillated around a support shaft 16. A spring 17 is provided between the oscillating arm member 15 and a body frame 18 so as to press the oscillating arm member clockwise around the shaft 16. The oscillating arm member 15 is oscillated indirectly by using a cam member that is independently swingable relative to the support shaft 16 and a torsion spring 25. An oscillating unit 20 for oscillating the oscillating arm member 15 includes: a cam member 21 that is rotated while supported by a cam shaft 22; a cam follower 23 oscillated by the cam member 21; and a stud 24 and the torsion spring 25 arranged integrally with the cam follower 23. The torsion spring 25 is disposed between the stud 24 and a pin 26 provided on the oscillating arm member 15. The oscillating arm member 15 is pressed onto the transfer drum 2 by the torsion spring 25, so that the pressure roller 3 is pressed onto the sheet support surface of the transfer drum 2.

Figure 2:
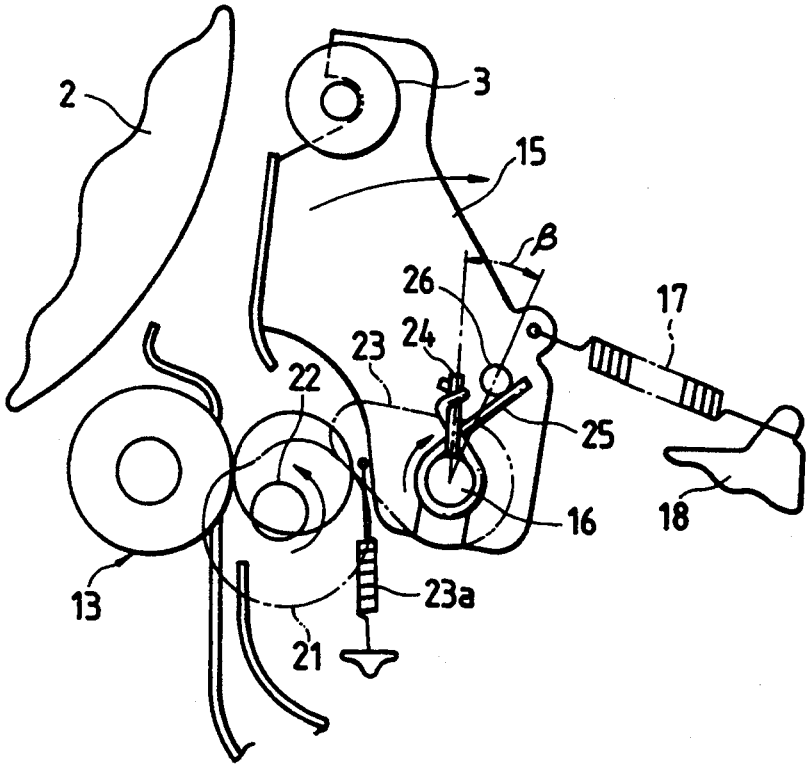
FIG. 2 is a diagram illustrative of a state in which the pressure roller is distanced from a transfer drum.

When the pressure roller 3 is distanced from the transfer drum 2 by causing the cam follower 23 to be oscillated by the cam member 21, the state shown in FIG. 1 is changed to a state shown in FIG. 2. As shown in FIG. 2, to distance the pressure roller 3 from the transfer drum 2, the spring 17 arranged for the oscillating arm member 15 gives a torsional action. As a result, the pressing operation by the torsion spring 25 is released, which is followed by an oscillating operation by the torsion spring 17. With the oscillating arm member 15 being oscillated clockwise, the pressure roller 3 is distanced from the transfer drum 2 to form a predetermined gap therebetween. Therefore, the pressure roller driver of the invention can perform the operation causing the pressure roller 3 to contact and leave the transfer drum 2 by the spring 17 and the torsion spring 25 arranged on the oscillating unit.

In thus constructed pressure roller driver of the invention, the oscillating arm member 15 supporting the pressure roller 3 is not only oscillated but also pressed onto the transfer drum 2 through the torsion spring 25 disposed on the oscillating unit 20 as described above. As a means for pressing the oscillating arm member in the oscillating unit, the cam follower 23 and the stud 24 which are oscillated relative to the support shaft 16 independently of the oscillating arm member are provided. The torsion spring 25, a part of which is attached to the stud 24, is attached to the pin 26 of the oscillating arm member 15. The stud 24 is oscillated together with the cam follower 23 when the cam follower 23 is oscillated by the cam member 21.

In FIG. 1 showing the state in which the oscillating arm member 15 presses the pressure roller 3 onto the transfer drum 2, an angle $\alpha$ which is formed by the shaft 16, the stud 24, and the pin 26 is set, so that the pressure force of the torsion spring 25 is given strongly to thereby press the pressure roller 3 onto the transfer drum 2. In contrast thereto, in FIG. 2 showing the state in which the oscillating arm 15 is oscillated clockwise through the shaft 16, an angle $\beta$ formed between the stud and the pin is set to a value smaller than the angle a for pressing the pressure roller. Therefore, in the pressure roller driver of the invention, to press the pressure roller 3 onto the transfer drum 2, the torsion spring gives torsion to press the pressure roller 3 even if the pressure roller is set at a position corresponding to the transfer drum. As a result, a predetermined pressing operation can be exerted onto the sheet in such a manner as to be flexible to irregularities on the surface of the transfer drum.

Further, the pressure roller pressing mechanism of the invention is designed to transmit the cam member's operation of oscillating the cam follower 23 and the stud 24 to the oscillating arm member through the torsion spring 25. Therefore, even if the oscillating arm member is set at a position for pressing the pressure roller, some allowances remain for the spring member pressure force. Even if a sheet is jammed in the course of setting the pressure roller at the pressing position and pressing the sheet onto the transfer drum, the sheet can be taken out with ease by distancing the pressure roller from the transfer drum.

In the above-mentioned pressure roller driver of the invention, the shape of the oscillating arm member for supporting the pressure roller, the structure of the torsion spring, the shapes of the cam member and the cam follower constituting the oscillating unit, or the like may be selected arbitrarily as long as such shapes and structure are suitable for performing the above-mentioned operations satisfactorily. Further, to oscillate the oscillating arm member through the torsion spring, measures such as setting the angle at which to operate the torsion spring to a large value can be taken. Therefore, the pressure roller supporting conditions can be selected arbitrarily as long as the function of pressing the sheet onto the transfer drum and the allowances for the pressure roller to near and leave the transfer drum can be maintained satisfactorily.

The pressure roller driver for a sheet forward apparatus of the invention is, as described above, characterized as forming a mechanism for indirectly oscillating the oscillating arm member that supports the pressure roller through the spring member, thereby allowing the pressure roller to be pressed resiliently onto the sheet supporting surface of the transfer drum. Since the pressure roller driver of the invention does not drive the oscillating arm member directly, even if a sheet has been jammed at the pressing section of the pressure roller, the pressing operation of the pressure roller can be released with ease. Further, the pressure roller supporting mechanism of the invention can easily adjust the pressure force for the sheet by adjusting the force of the torsion spring, thereby allowing the sheet to be held by the transfer drum while pressed by a necessary force.

What is claimed is:

1. A sheet forwarding apparatus for supporting a transfer sheet on a transfer drum in an electrophotographic copying machine, onto which a toner image on a photoreceptor drum is transferred, said apparatus comprising:

a pressure roller for pressing said sheet onto said transfer drum while forwarding the sheet;

an arm member supporting said pressure roller and pivotably mounted on a first shaft so that pivotal movement thereof on said first shaft causes said pressure roller to contact and to move away from said transfer drum;

a first spring member mounted on said first shaft for exerting pressure on said arm member and causing said arm member to pivot and cause said pressure roller to contact said transfer drum;

a cam follower mounted on said first shaft and arranged integrally with said first spring member;

a rotatable cam member supported on a second shaft for oscillating said cam follower when said cam member is rotated;

a second spring member connected to said arm member for urging said arm member to pivot and move said pressure roller away from said transfer drum;

wherein the oscillation of said cam follower causes the pressure exerted on said arm member by said first spring to be reduced so that said second spring causes said pressure roller to move away from said transfer drum.

2. The apparatus of claim 1, wherein said arm member is provided with a pin, said first shaft is provided a stud, and said first spring member is a torsion spring disposed between said pin and said stud.

* * * * *